US011542672B2

(12) United States Patent
Pedretti

(10) Patent No.: US 11,542,672 B2
(45) Date of Patent: Jan. 3, 2023

(54) PNEUMATIC SUPPORT

(71) Applicant: PIBRIDGE LTD, Lugano (CH)

(72) Inventor: Mauro Pedretti, Biasca (CH)

(73) Assignee: Pibridge Ltd., Lugano (CH)

( * ) Notice: Subject to any disclaimer, the term of this patent is extended or adjusted under 35 U.S.C. 154(b) by 327 days.

(21) Appl. No.: 16/613,335

(22) PCT Filed: Apr. 25, 2018

(86) PCT No.: PCT/CH2018/050012
§ 371 (c)(1),
(2) Date: Nov. 13, 2019

(87) PCT Pub. No.: WO2018/209453
PCT Pub. Date: Nov. 22, 2018

(65) Prior Publication Data

US 2020/0399842 A1 Dec. 24, 2020

(30) Foreign Application Priority Data

May 16, 2017 (CH) ..... 00646/17

(51) Int. Cl.
*E01D 19/12* (2006.01)
*E04H 15/20* (2006.01)
(Continued)

(52) U.S. Cl.
CPC ..... *E01D 19/125* (2013.01); *E04H 15/20* (2013.01); *E04C 3/005* (2013.01); *E04C 3/46* (2013.01);
(Continued)

(58) Field of Classification Search
CPC . E01D 19/125; E04H 15/20; E04H 2015/201; E04H 2015/204; E04C 3/005; E04C 3/46
(Continued)

(56) References Cited

U.S. PATENT DOCUMENTS 2,636,457 A * 4/1953 Rohlfs ..... E04H 15/20 52/2.25
8,161,687 B2 * 4/2012 Crettol ..... E04C 3/005 52/2.13
(Continued)

FOREIGN PATENT DOCUMENTS

WO WO-01/73245 A1 10/2001
WO WO-03/016634 A1 2/2003
(Continued)

OTHER PUBLICATIONS

Beucher, Stefan, International Search Report for PCT/CH2018/050012 (dated Feb. 7, 2018) (2 pages).

*Primary Examiner* — Raymond W Addie
(74) *Attorney, Agent, or Firm* — Henry Patent Law Firm PLLC

(57) ABSTRACT

A pneumatic support having a body (112) which can be pneumatically pressurised and which, when under operating pressure, operationally holds a compression member (96, 128 to 131') which extends substantially over the length of the body and a tensile member (98, 138 to 141') which likewise extends substantially over the length (I) of the body at a distance from each other, wherein the compression member (96, 128 to 131') and the tensile member (98, 138 to 141') are connected to each other at the end in connection nodes (91), and wherein the body which can be pneumatically pressurised has pneumatic drop-stitch transverse fibre pressure panels (100, 165, 113 to 116).

20 Claims, 10 Drawing Sheets

(51) Int. Cl.
*E04C 3/00* (2006.01)
*E04C 3/46* (2006.01)

(52) U.S. Cl.
CPC .. *E04H 2015/201* (2013.01); *E04H 2015/204* (2013.01)

(58) Field of Classification Search
USPC ..... 14/2.4, 73, 75, 77.8
See application file for complete search history.

(56) References Cited

U.S. PATENT DOCUMENTS 8,782,957 B2 * 7/2014 Luchsinger ..... E04H 15/20 52/2.13
8,991,104 B2 * 3/2015 Warner ..... E04C 3/38 52/2.21
10,174,466 B2 * 1/2019 Pedretti ..... E04C 3/005
10,689,813 B2 * 6/2020 Pedretti ..... E04C 3/46
2009/0282746 A1 * 11/2009 Luchsinger ..... E04H 15/20 52/2.11
2010/0146868 A1 * 6/2010 Lukasiewicz ..... E04H 15/18 52/741.1
2011/0252716 A1 * 10/2011 Pedretti ..... E04H 15/20 404/136
2013/0291709 A1 * 11/2013 Woods ..... B29C 53/58 87/9

FOREIGN PATENT DOCUMENTS

WO WO-2005/007991 A1 1/2005
WO WO-2005/042880 A1 5/2005
WO WO-2007/147270 A1 12/2007
WO WO-2015/176192 A1 11/2015

* cited by examiner

PNEUMATIC SUPPORT

TECHNICAL FIELD

The present invention relates to a pneumatic support as well as to a method for the production thereof.

BACKGROUND

Pneumatic supports of the mentioned type are known and are based on a cylindrical basic shape according to WO 01/73245. This basic shape has been further developed to a spindle-shaped support according to WO 2005/007991, among other things.

The advantage of such pneumatic supports is their low weight as well as the extremely small transport volume, because the inflatable body is foldable and the tensile members can be embodied as cables. It is a disadvantage of such pneumatic supports that even though they can support high area loads, thus are suitable for many intended purposes, they are only suitable to a limited extent for asymmetrical loads as compared to the possible area load, which prevents in particular the use as bridge, because an axle, for instance of a truck, which rolls over a bridge, represents a particularly unfavorable case in this regard.

It is a further disadvantage of such pneumatic supports that the inflatable bodies are subject to being damaged in the operating state.

FIGS. 1*a* to 1*d* show, in an exemplary and schematic manner, pneumatic supports according to the prior art, which, for the sake of clarity, are illustrated with exaggerated thickness. FIG. 1*a* shows a pneumatic support 1 according to WO 2005/042 880 comprising a compression member 2, a tensile member 3, and an inflatable pneumatic body 4, which is illustrated by means of dashes is arranged between compression member 2 and tensile member 3, and which is inflated to operating pressure and thus keeps the compression member 2 and the tensile member 3 at a distance from one another.

The pneumatic body 4 preferably consists of a gas-tight, flexible, substantially inextensible material, which forms a sleeve, which can be folded for transport, and which, when under operating pressure, takes a shape, which is matched to the respective pneumatic support.

On its ends 6, 7, the support 1 is supported via bearings 8, 9, the compression member 2 and the tensile member 3 are also connected to one another there via a node 10, 11. A schematically suggested paneling 12 allows to use the support 1 as bridge here.

The following concept can explain the mode of operation of the support:

If a load 13 acts on the paneling 11 and thus on the compression member 2, the latter is supported by the inflatable body 4, which is under operating pressure, but which, in turn, rests on the tensile member 3, which thus does in fact support the load 13. The tensile member 3 thus strives to escape downwards, which is not possible, however, because the compression member 2 holds the common end nodes 10 and 11, thus also the ends of the tensile member 3, at a distance from one another. Those regions, in which the compression member 2 and the tensile member 3 are operationally connected to one another, are referred to as end nodes 10, 11. Force from the compression member 2 is transferred into the tensile member, and vice versa, force from the tensile member 3 is also transferred into the compression member 2 by means of the end nodes 10, 11.

The end nodes 10, 11 thus represent force introduction points for both the compression member 2 and the tensile member 3.

It follows that the tensile member 3 is substantially only subjected to axial tension, and the compression member 2 is substantially only subject to axial pressure, so that the tensile member 3 can be embodied as cable, and the compression member 2 as thin rod. A pressurized thin rod, however, is at risk of buckling, with the result that the buckling limit of the compression member 2 determines the load-bearing capacity of the support 1.

A reduced risk of buckling results in the case of an area load, which is distributed symmetrically over the length of the support, as is the case, for instance, in the case of roof structures, because a buckling in a direction against the load application is reduced by the load itself, and a buckling caused by the bearing of the compression member on the pneumatic body 4 is prevented in the load direction.

In the case of an asymmetrical load, however, the compression member sinks in the body 4 to an increasing extent at the location of the load 13, and instead bends upwards at a different location, with a tendency to bend beyond the bearing surface on the body 4 and to thus lift off therefrom, which results in an increased buckling risk and in a load-bearing capacity of the support 1, which is relevantly reduced thereby.

Connecting elements, embodied as pure tensile members 14, which connect the compression member 2 to the tensile member 3, are thus preferably arranged vertically (i.e. in the load direction and perpendicular to the longitudinal axis of the support 1). The tensile members 14 are suitable to prevent to a certain extent that the compression member 2 lifts off the body 4 at a non-loaded location and thus buckles, in the case of an asymmetrical load. The horizontal distance of the tensile members 14 is to be optimized by the person of skill in the art with regard to the concrete case.

The connecting points between the tensile members 14 and the compression member 2 and also the tensile member 3, in turn, represent force introduction points or connecting elements, respectively, for these elements.

FIG. 1*b* shows a pneumatic support 15 according to WO 2015/176 192, which also rests on bearings 16, 17 and has two end nodes, which are embodied as ramp-shaped barriers 18, 19, and three pneumatic segments 20 to 22, wherein each of the pneumatic segments has a compression member 23 to 25, which is embodied for example as pressure rod, a tensile member 26 to 28, which is embodied here for example as tensile rod (a tensile cable would also be possible), and a pneumatic body 29 to 31, wherein each pneumatic body 29 to 31, in turn, operationally holds the respective assigned compression member 23 to 25 and the respective assigned tensile member 26 to 28 at a distance from one another by means of its operating pressure. By means of two connecting elements 32, 33, which run in a zigzag-shaped manner through each segment 20 to 22 in a gapless manner (and thus in a gapless manner through the pneumatic support formed by the shown arrangement) at an angle of preferably 45°, a structure is formed, which is suitable and stiff in particular for asymmetrical loads, i.e. which only still sags downwards insignificantly under operating load, for example with respect to the support of FIG. 1*a* from the straight (unloaded) target position.

The connecting points of the nodes 18, 19 also form force introduction points in the compression members 23 to 25 and in the tensile members 26 to 28 with the respective compression member 23, 25, tensile member 26, 28, and the connecting points of the compression members 23 to 25 as well as of the tensile members 26 to 28 with the connecting elements 32, 33.

FIG. 1*c* shows a carrier 40, also according to WO 2015/176 192, which is constructed analogous to the support 15 according to FIG. 1*b*, here has four pneumatic segments 41 to 44, and has a modified longitudinal cross section, i.e. an only slightly convex upper side and a strongly convex lower side.

FIG. 1*d* shows a support 45, also comprising a plurality of pneumatic segments 46 to 50, comprising a further modified longitudinal cross section in such a way that it can be loaded in the manner of a vaulted structure.

The supports 1, 15, 40, 45 have the common advantage that, being disassembled, they can be transported easily and assembled on location in that the end nodes, compression members, tensile members, and possible connecting elements are assembled, the pneumatic bodies are then inflated and are pressurized to an operating pressure. It is a disadvantage that the supports 1, 15, 40, 45 increasingly curve during the pressure buildup and finally, under operating pressure, but load-free, assume a position, which is curved in an arc-shaped manner, and assume their stretched target position shown in FIGS. 1*a* to 1*d* only under a load, and finally bend strongly under the operating load in the case of a support in the manner of the support 15 shown in FIG. 1*a*, and only to a reduced extent in the case of a support in the manner of the supports 15, 40, 45 shown in FIGS. 1*b* to 1*d*.

The curvature (i.e. the unwanted deformation, which still results when inflating the pneumatic supports 4 and 29-31 without load) thereby occurs in the direction of the stronger curvature of the compression member or of the tensile member, respectively, so that the supports of FIGS. 1*a*, 1*b*, and 1*d* are curved upwards without load, and the support according to FIG. 1*c* is curved downwards. In the load-free state, the end nodes thus shift against one another accordingly, which is unwanted.

The curvature of the supports 1, 15, 40, and 45 is illustrated schematically in FIGS. 1*e* to 1*h* by means of the longitudinal center lines thereof, wherein the longitudinal center lines 55 to 58, which are illustrated in a dashed manner, corresponds to the target position, as it is illustrated in FIGS. 1*a* to 1*d*. The solid center lines 59 to 62 are illustrated in an extrapolated and only qualitative manner according to the actual position under operating pressure, but load-free (i.e. according to the curvature). The dot-dashed longitudinal center lines 58 to corresponds to the actual position under operating pressure and operating load, i.e. the load deformation, wherein, for the sake of simplicity, a load is assumed in each case, which, to simplify the figure, is not illustrated, and which applies in the center of the support 1, 15, 40, and 45.

It can be seen from FIG. 1*e* that the pneumatic support 1 illustrated in FIG. 1*a* displays a comparatively large curvature and additionally a comparatively large sag. The entire shift of the longitudinal center line is too large for many applications.

It can be seen from Figure if that the pneumatic support 15 illustrated in FIG. 1*b* shows a center curvature and additionally an only small, insignificant sag under load. The only center curvature is caused by the fact that the center segment 21 (FIG. 1*b*) is symmetrical to its longitudinal center line, thus substantially does not curve (except for an asymmetry, which originates, for example, from manufacturing tolerances).

It can be seen from FIG. 1*g* that the pneumatic support 40 illustrated in FIG. 1*c* displays a comparatively large downwards curvature and additionally a comparatively large sag under load.

It can be seen from Figure if that the pneumatic support 451 illustrated in FIG. 1*d* displays a comparatively large curvature, but low sag under load.

The above-discussed ratios for a support according to FIG. 1*d* can be seen from FIG. 1*h*.

Depending on the intended use, curvature or sag, respectively, play or do not play a role—the curvature is unfavorable, for example in the case of a bridge, which should be as flexurally stiff as possible. It is thus particularly disadvantageous when a bridge, formed of supports according to FIG. 1*b*, is extremely flexurally stiff and would thus be particularly suitable for its use, but has to be navigated steeply at the ends due to the curvature, and then acts in a spongy/flexible manner up to its target position (line 18 of FIG. 1*f*). The advantage of the flexural stiffness thus displays its advantage only to a reduced extent.

Depending on the intended use, this also applies analogously for other pneumatic supports, for example according to FIGS. 1*a* to 1*h*.

It is thus the object of the present invention to create a pneumatic support, which only displays the phenomenon of the curvature to a reduced extent or which avoids it.

It is a further object of the present invention to create a pneumatic support, which, regardless of the phenomenon of the curvature, maintains a load-bearing capacity even in the case of damages to the pneumatic body with associated pressure loss.

The object with regard to a load-bearing capacity, which is to be maintained, is solved according to the characterizing features of the present disclosure.

Due to the fact that the pneumatic body has pneumatic transverse fiber pressure panels, it can be assembled easily from numerous segments in such a way that, in the case of loss of the functionality of one or a plurality of segments, the support still remains load-bearing and thus operational.

The invention will be described in more detail below on the basis of the figures, in which

DETAILED DESCRIPTION

Figure 1A:
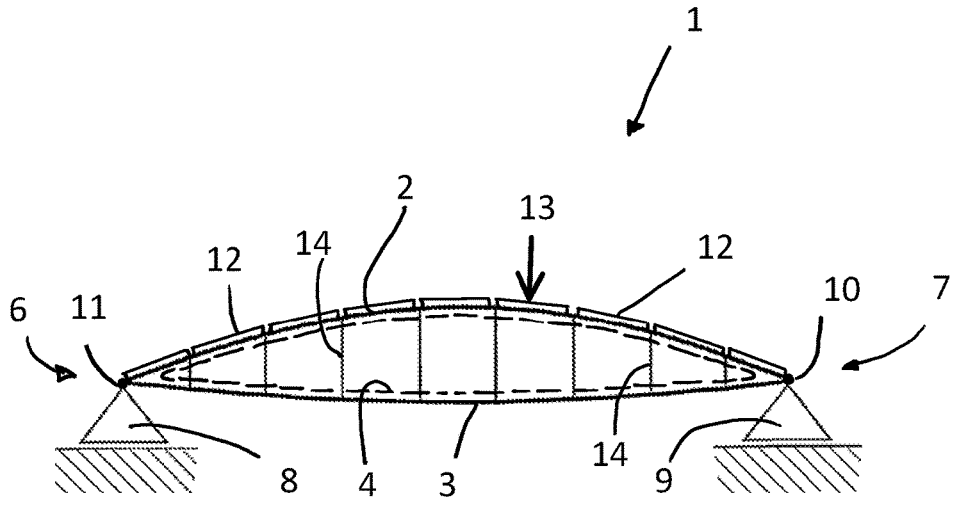
FIGS. 1*a* to 1*d* schematically show pneumatic supports according to the prior art, FIGS. 1*e* to 1*h* schematically show the curvature of the pneumatic supports under load-free operating pressure, under operating pressure and operating load, as well as in a target position without curvature, FIG. 2 schematically shows a pneumatic support embodied according to the invention, FIG. 3*a* schematically shows a pneumatic support, which is embodied according to the invention and which is secured against pressure loss in the pneumatic body.
Figure 1B:
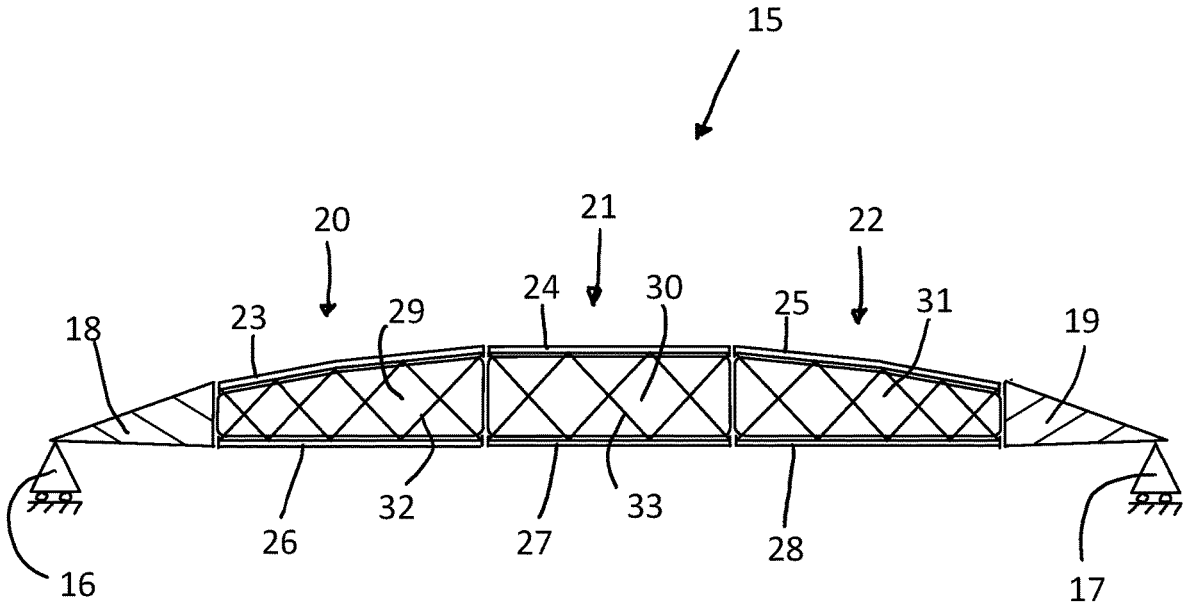
Figure 1C:
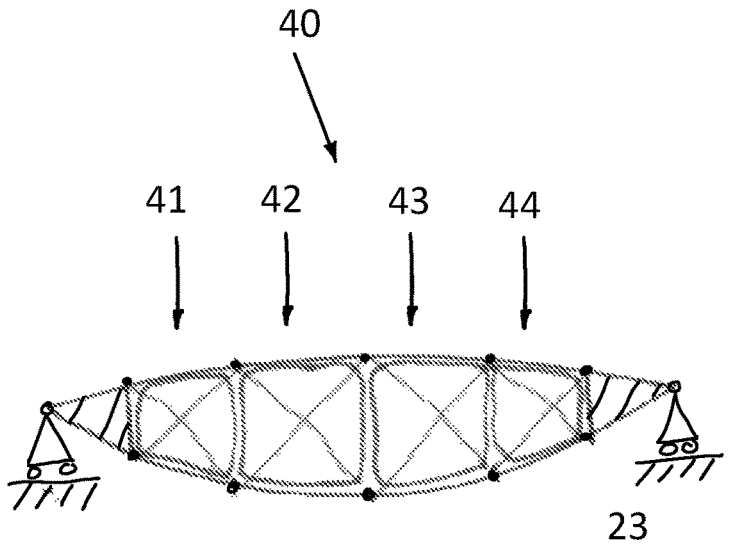
Figure 1D:
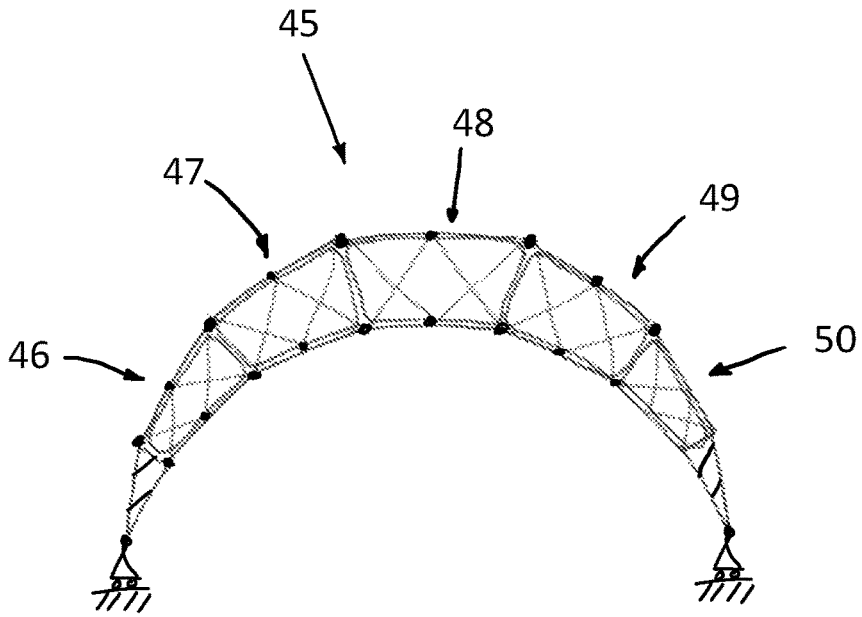
Figure 1E:
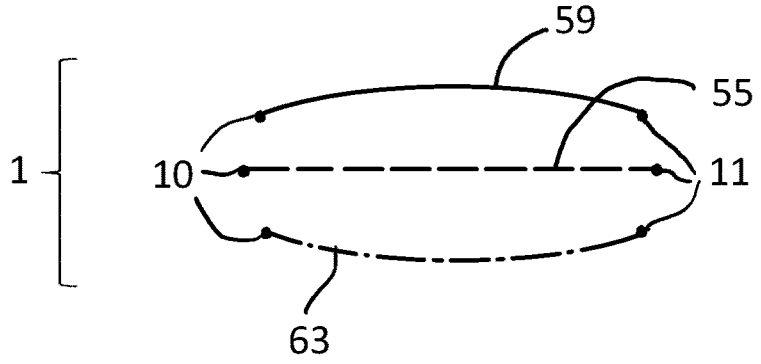
Figure 1F:
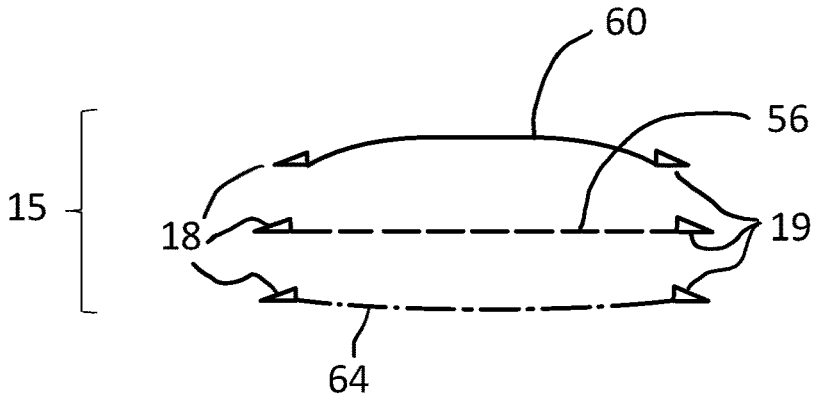
Figure 1G:
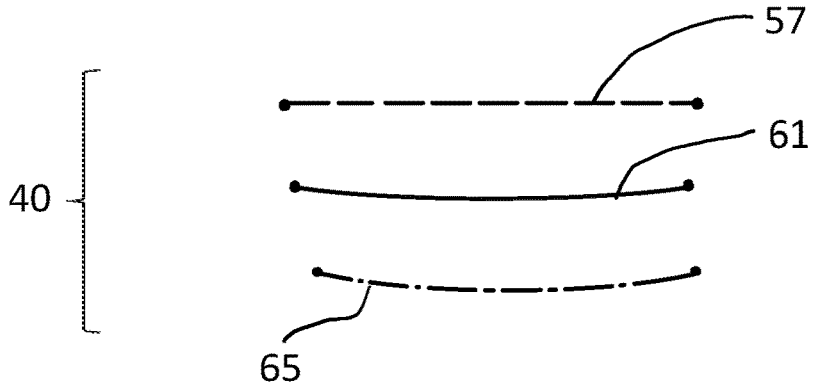
Figure 1H:
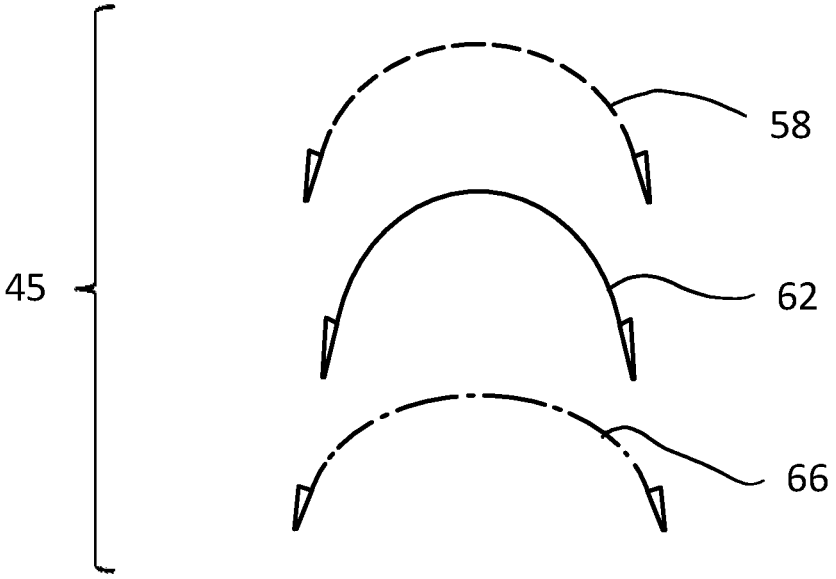
Figure 2:
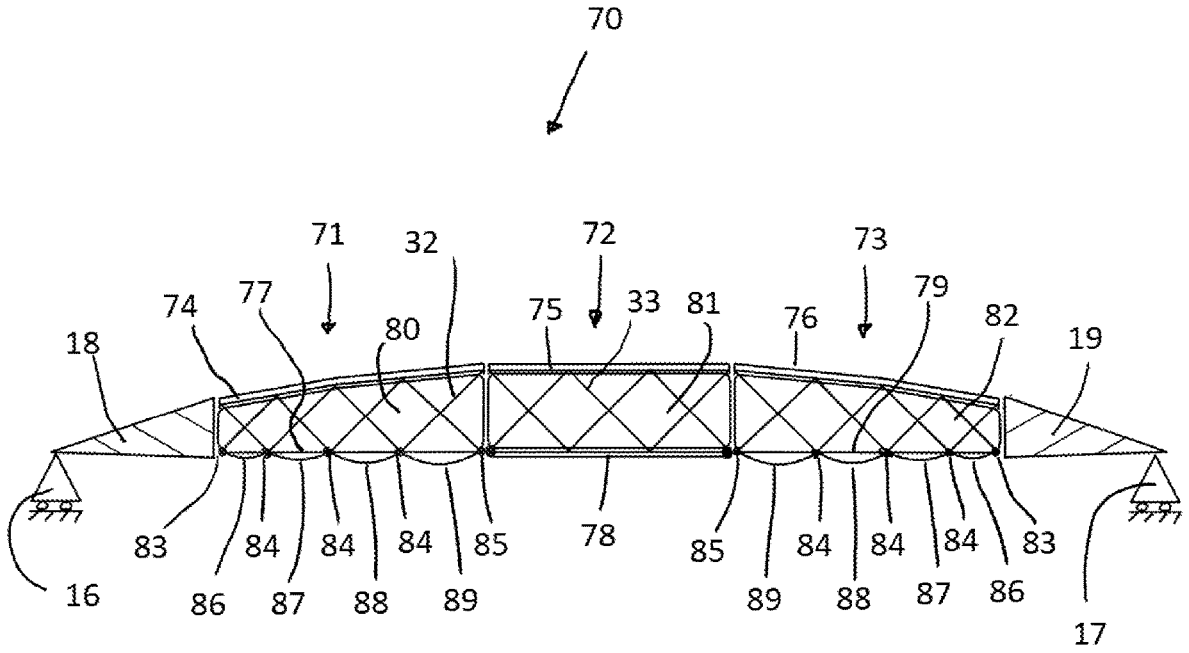

FIG. 2 shows a first embodiment according to the invention of a pneumatic support 70, which is constructed analogously to the support 15 of FIG. 1*b*, which has three segments 20 to 22. The segments 71 to 73 can be seen, wherein the segments 71 and 73 are modified, and the setup of segment 72 corresponds to segment 21 of the support 15 (FIG. 1*b*).

It should be noted at this point that any type of the pneumatic support can generally be modified in accordance with the invention, if and insofar as it has the phenomenon of the curvature.

The pressure rods 74 to 76 as well as the tensile elements, which are embodied as tension cables 77, 79, as well as the tension rod 78 of the segments 71 to 73 are illustrated. The connecting elements 33, 34, which are unchanged as compared to the embodiment of FIG. 1*b* and which reinforce the pneumatic support 70 in the case of the operating load, are likewise illustrated. The pneumatic body 81 is likewise unchanged as compared to the embodiment of FIG. 1*b*, while the pneumatic bodies 80, 82 are modified in accordance with the invention according to the following description.

FIG. 2 further shows the force introduction points 83, 84, and 85, which are present in the segments 71, 73, wherein the force introduction points 83 connect the connecting element 33, the barrier 18, and the tension cable 77 to one another, and thus introduce the corresponding forces into the tension cable 77. The force introduction points 85 connect the tension rod 78, the connecting elements 33 or 34, and the tension cable 77, whereby the corresponding forces are introduced into the tension cable 77. The force introduction points 84 connect the tension cable 77 to the connecting element elements 32, 33, and introduce the corresponding forces into the tension cable 77. Moldings 86 to 89, which, according to the embodiment of FIG. 2, are provided on the side of the tension member, are provided between adjacent force introduction points 83, 84 or 84, 84, respectively, and 84, 85 in the pneumatic bodies 80, 82.

By means of these moldings 86 to 89, a balance of forces, in the case of which a deformation of the pneumatic body due to the operating pressure—in contrast to the prior art—is substantially eliminated, results in accordance with the invention in the pneumatic bodies 80, 82 due to the operating pressure. The moldings 86 to 89 are thereby advantageously, and preferably as shown in FIG. 2, embodied in an arc-shaped manner, more preferably in a circular arc-shaped manner, and extend from a force introduction point 83 to 85 to the adjacent force introduction point 84.

The moldings 86 to 89 thereby further preferably have a height of between 10 and 15% of the distance of these force introduction points 83 to 85 over the connecting line between the force introduction points 83 to 85, which limit them. The applicant has found that such a height effectively reduces the unwanted curvature.

Finally, the tensile member 77, 79 is further preferably operatively connected to the pneumatic body 80, 82 only at the location of the force introduction points 83 to 85, so that the tensile member can extend straight between the force introduction points 83 to 85, and does not have to follow the contour of the pneumatic body 80, 82 or the contour of the moldings 86 to 89, respectively, which, when under operating pressure, leads to a shortening of the distance of the force introduction points 83, 85, and then to a more complicated design of the entire segment 71, 73 with respect to the pressure rod 74, 76, the pressure body 80, 82, the tension cable 77, 79, and the contour of the moldings 86 to 89, which can only be calculated in a very complex manner and which would thus need to be determined by means of tests.

It thus follows that, according to the preferred embodiment shown in the figure, a pneumatic support (comprising one or a plurality of asymmetrical pneumatic bodies in the longitudinal direction), in the case of which, under operating pressure, but load-free, the side of which, which has the compression member, is at least partially curved in an arc-shaped manner, and the side of which, which has the tensile member, is embodied in such a way that the force introduction points thereof substantially lie on a straight line.

It should be noted at this point that the configuration of the pneumatic support according to FIG. 2 can obviously be modified, for example in that the center segment is omitted, so that the side having the compression member is curved in a continuously arc-shaped manner. In a simulation, the applicant has determined the curvature of a pneumatic support with a length of 38 m for an operating load of 4.5 t with continuously arc-shaped compression member and straight tensile member (it should be possible to especially construct such a configuration in a favorable manner in the field, because the tensile member or the lower side, respectively, of the pneumatic support then bears on the ground). The curvature, however, leads to a "hump" of the support with a height of approx. 1 meter, wherein the tensile member is raised off the ground approximately at the same height in the center of the support. However, the pneumatic support, which is provided with moldings according to the invention, with otherwise identical configuration as the support of the prior art, was substantially free from the curvature, which was only still in the range of approx. 10 cm.

In summary, a pneumatic support follows according to the invention, comprising one (or a plurality of) pneumatic bodies, which can be pneumatically pressurized and which, when under operating pressure, operationally holds a compression member, which extends substantially over the length of the body, and a tensile member, which likewise extends substantially over the length of the body, at a distance from one another, wherein, in end regions of the compression member and of the tensile member, forces are introduced into them in force introduction points, and wherein connecting elements are provided between the compression member and the tensile member, which also introduce forces into the compression member and the tensile member in force introduction points, wherein the pneumatic body has moldings, which extend between adjacent force introduction points and which protrude to the outside via a straight connection between the adjacent force introduction points.

As already mentioned above, the pneumatic support preferably has a flexible sleeve (namely the pneumatic body—or, in the case of a plurality of segments, a plurality of pneumatic bodies comprising a plurality of flexible sleeves), the mold of which determines the shape of the support under operating pressure in such a way that the moldings form in predetermined contour.

Due to the fact that at least one connecting element is preferably provided in the pneumatic support, which extends in a zigzag-shaped manner continuously through the entire length of the pneumatic body, and which, as mentioned above, particularly preferably runs at an angle of 45° with respect to the provided load direction (in the case of a bridge thus 45° to the horizontal). This is why the adjacent force introduction points have a different distance from one another, when the distance of compression member and tensile member changes, as it is the case from the embodiment according to FIG. 2 in the segments 71, 73 or generally in the case of compression bodies, which are embodied asymmetrically over a length, respectively. The moldings 86 to 89, in turn, thus have a different height, because this height is preferably determined in relation to the distance of the assigned force introduction points.

The height of the moldings is determined in a particularly simple iterative manner, because the calculation for this is complex: In a first step, the height is determined to between 10 and 15% of the distance of the assigned (i.e. adjacent) force introduction points. The pneumatic support can then still have an unwanted residual curvature, so that, in a second step, the height of the moldings is increased further by 30-50% (in the case of an initial increase of 10%, the resulting height would then be between and 15% of the distance of the adjacent force introduction points). This iterative method converges very quickly in the case of most of the configurations of a pneumatic support, which is to be determined by the person of skill in the art for the concrete case, but can be readily continued, until the curvature is substantially eliminated or until no further improvement occurs for the designated intended use of the support, respectively.

It follows in detail that a method is provided in accordance with the invention, in the case of which arc-shaped, preferably circular arc-shaped moldings are preferably provided in a pneumatic support, the height of which is between 10 and 15% of the distance of the assigned force introduction points.

The structure of a pneumatic support according to the invention is thus preferably embodied in such a way that one (or a plurality of) moldings has a height above the connecting line of between 10 and 15% of the distance of the force introduction points between these force introduction points limiting it.

For the case of the use of the iterative method, the pneumatic support, which is designed according to the invention, is then constructed, and the pneumatic body of the support is brought to operating pressure, and it is verified, whether a curvature of the support, which continues with respect to the provided shape, is present, and, in the positive case, the height of selected moldings is increased by 30-50%. The person of skill in the art will usually increase all moldings evenly, but can change only selected moldings in the case of a special shape of the concerned pneumatic body, for example by means of tests).

If desired for the designated intended purpose of the pneumatic support, the iterative method can finally be continued, i.e. the height of the moldings can be increased iteratively until a further increase does not result in a further improvement of the curvature of the unloaded support.

As a result, a method for providing a pneumatic support is provided according to the invention, in the case of which the shape of the pneumatic support and the location of the force introduction points and then the curvature, which is to be expected under operating pressure but without operating load, is determined in advance, and moldings are then provided at the inner curvature side of the pneumatic support, which moldings extend outwards from force introduction point to force introduction point over a connecting line between assigned force introduction points.

Figure 3A:
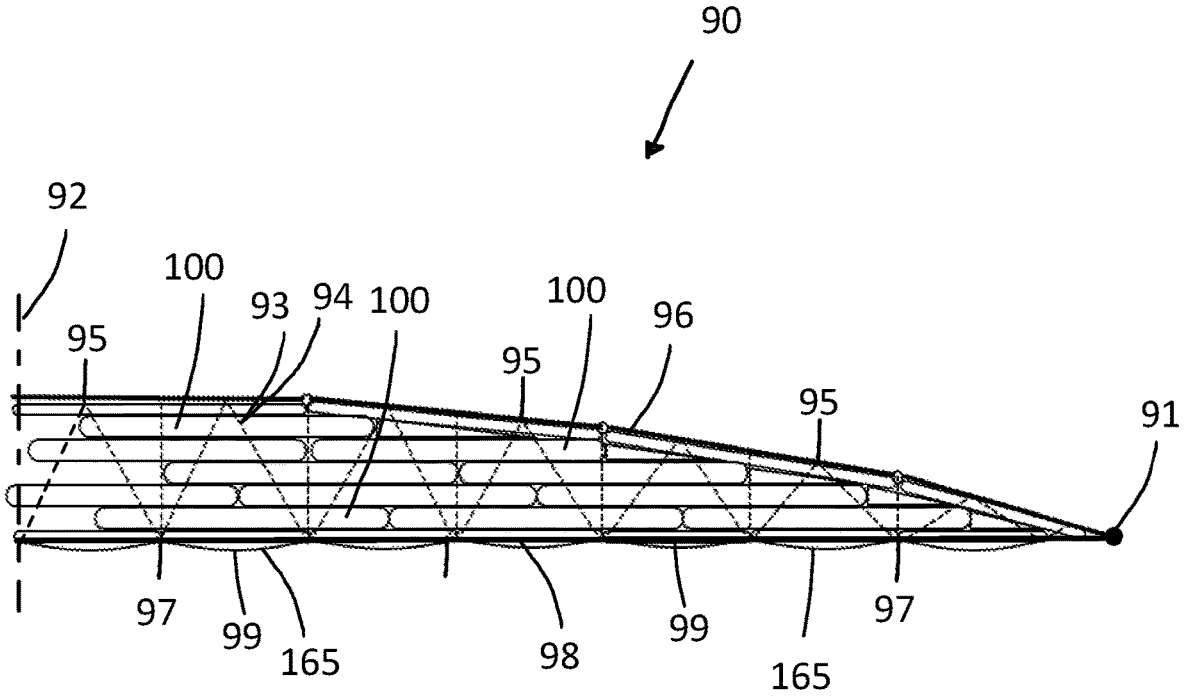
FIG. 3*b* shows the support of FIG. 3*a* in cross section.
FIG. 3*c* shows an embodiment of the support of FIG. 3*a* in cross section, FIG. 4 schematically shows a section from the support of FIG. 3*a* at the location of a force introduction point located between two moldings, FIG. 5 schematically shows a cross section through a further embodiment of the support according to the invention.

FIG. 3*a* shows the right half of a support 90, comprising a right end node 91 and the symmetry line 92, which limits the right half (the left half is embodied symmetrically to the right half, corresponding to the symmetry line).

The basic setup of the support 90 is analogous to the support 70 (FIG. 2), but can also correspond to a support according to FIGS. 1*a* to 1*d* or similar pneumatic supports. In contrast to the support 70, two connecting elements 93, 94 are provided in the case of the support 90, wherein one runs along one of the outer sides of the support 90 in each case. The connecting element 93, which is visible in the viewing direction onto FIG. 3*a*, thereby covers the connecting element 94 located behind said connecting element 93, on the other side of the support 90. The connecting elements run along the support 90 in a zigzag-shaped manner, and are operatively connected at connecting or force introduction points 95, respectively, in the compression member 96, and at connecting or force introduction points 97, respectively, at the tensile member 98. Moldings 99 are located on the side of the tensile member 98.

According to the invention, the body, which is arranged between the compression member 96 and the tensile member 98, and which holds them at a distance from one another, and which can be pressurized pneumatically, has pneumatic fiber pressure panels 100. Such fiber pressure panels are pneumatic, i.e. inflatable, flat bodies, comprising an outer shape similar to an air mattress, wherein fibers, which connect bottom part and top part, are arranged in the interior between the bottom part of the sleeve and the top part of the sleeve, so that the panel-shaped contour of the fiber pressure panels 100 is also maintained under operating pressure. Such pneumatic fiber pressure panels are known to the person of skill in the art as "Drop Stitch" bodies and can consist of polyester/PVC membranes or also of other flexible materials, such as, for example, Hypalon.

In the figure, the entire body of the support 90, which can be pneumatically pressurized, is formed of pneumatic fiber pressure panels 100, which are layered one on top of the other, wherein the layers each preferably consist of a plurality of fiber pressure panels 100, which are arranged one behind the other and so as to abut against one another, and which are arranged so as to be offset in relation to an adjoining layer. Some fiber pressure panels 100 are omitted in the figure (which obviously have to be present in an operational embodiment of the support 100) at the left end, at the symmetry line 92, for clarifying the layering. In the case of a bridge formed by the support 90, the fiber pressure panels 100 are aligned horizontally in the shown embodiment.

The use of such fiber pressure panels 100 is advantageous, because the individual pressure panels are air-tight, a reserve fan can be omitted. If such a fiber pressure panel fails, for example due to breach from the outside, the load capacity of the support 90 is only minimally reduced. A fiber pressure panel 100, which has failed, can be replaced easily. The fiber pressure panels 100 can be dimensioned arbitrarily, i.e. can be tailored to a support 90, which is individually embodied for the concrete case. However, the fiber pressure panels, corresponding to the Lego system, can simultaneously be of standardized size and can be used for a large variety of supports. The certain inherent rigidity of fiber pressure panels 100 increases the inherent rigidity of the support 100. Logistics and handling of the support 90 become simpler: The pneumatic body, which is extremely unwieldy in the case of large pneumatic supports, consists of a number of fiber pressure panels 100, which, with a weight of several kilograms, can be handled easily individually. Due to the fact that the fiber pressure panels 100 have a width, roadway slabs can simply be place onto the top side of the pneumatic support 90 in the case of the bridge. Lower molded fiber pressure panels 101, the contour of which corresponds to the moldings 99, can likewise simply be placed onto their flexible support members (see the description of FIGS. 3*b* and 3*c* with regard to this). Finally, vertical outer walls of the pneumatic support 90 form due to the layering with fiber pressure panels 100, so that a plurality of supports 90 can be positioned next to one another in a simple way, for example in the case of a bridge. It is also important that the entire support 90 (which can reach or exceed a length of, for example, 10 m, 20 m, 30 m or also 40 m), can be set up without any machines (crane, forklift) in this case thanks to the individual components, which are light and have comparatively small dimensions.

In the case of an embodiment, which is not illustrated in the figure, the body, which can be pneumatically pressurized, is not formed completely, but only partially, by such pneumatic fiber pressure panels. The fiber pressure panels are then arranged, for example, at regions of the pneumatic support, which are at risk of being damaged, for example at that location, where a load applies or where the surface of the support is exposed otherwise.

A pneumatic support comprising a body, which can be pneumatically pressurized and which, when under operating pressure, operationally holds a compression member, which extends substantially over the length of the body, and a tensile member, which likewise extends substantially over the length of the body, at a distance from one another, thus follows in accordance with the invention, wherein the compression member and the tensile member are connected to one another at the end side in connection nodes, wherein the body, which can be pneumatically pressurized, further has pneumatic fiber pressure panels. Connecting points for at least one tensile connecting element, which extends between the compression member and the tensile member, are preferably provided at the compression member and at the tensile member.

It can be seen from FIG. 3*a* that transverse fiber pressure panels 165 (here the lowermost layer) are preferably embodied in such a way that the moldings are embodied over their transverse fibers, wherein the mold of the sleeve of the respective transverse fiber pressure panels 165 can also be embodied accordingly.

Figure 3B:
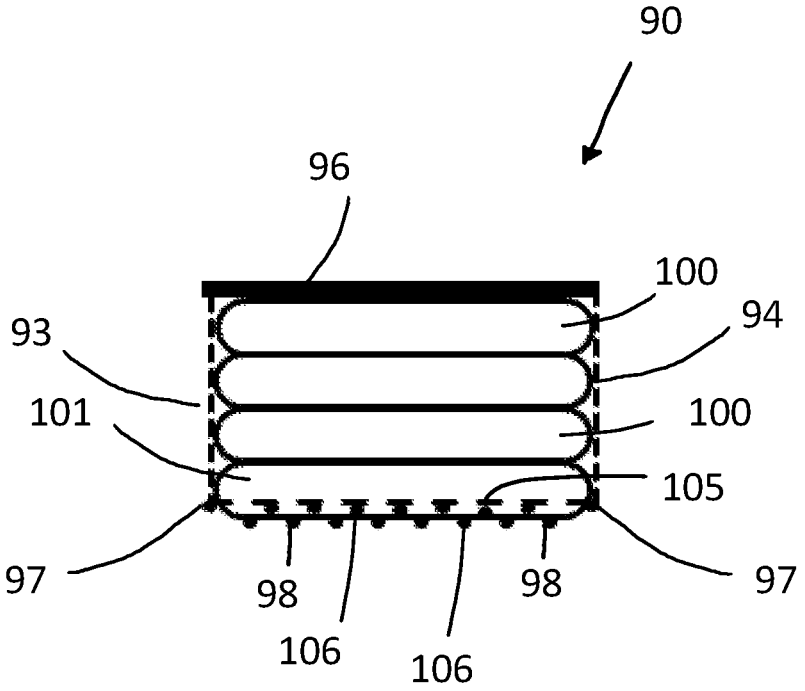

FIG. 3*b* shows the support 90 in cross section at the location of a force introduction point 97. Pneumatic fiber panels 100, which are layered on top of one another, are illustrated, comprising a lowermost fiber panel 101 here, which is molded so as to correspond to the moldings for reduced curvature of the support 90. The compression member 96, which is embodied as roadway slap (now visible in the cross section), as well as a number of tensile members 97, which run along the bottom side of the fiber pressure panels 101, is now visible, so that the fiber pressure panels 101 rest with their moldings on the tensile members (for example consisting of wire cables), which are arranged parallel to one another.

At the end side, transverse rods 105 form the force introduction points 97, with which the connecting elements 97 engage, and simultaneously also flexible support members 106 for the lowermost fiber pressure panels 105, which bear on the flexible support members 106.

Figure 3C:
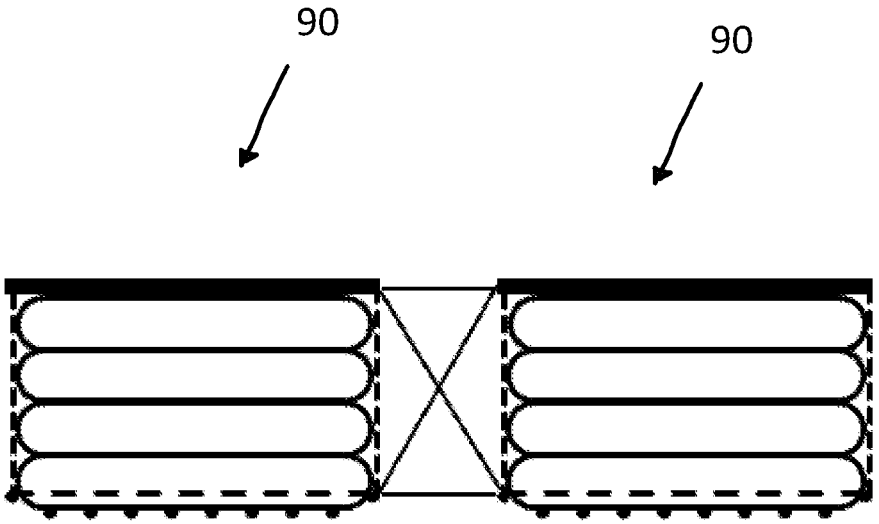

FIG. 3*c* shows two supports 90 arranged next to one another in cross section, wherein each support 90 can serve, for example as roadway for one side of a vehicle.

Figure 4:
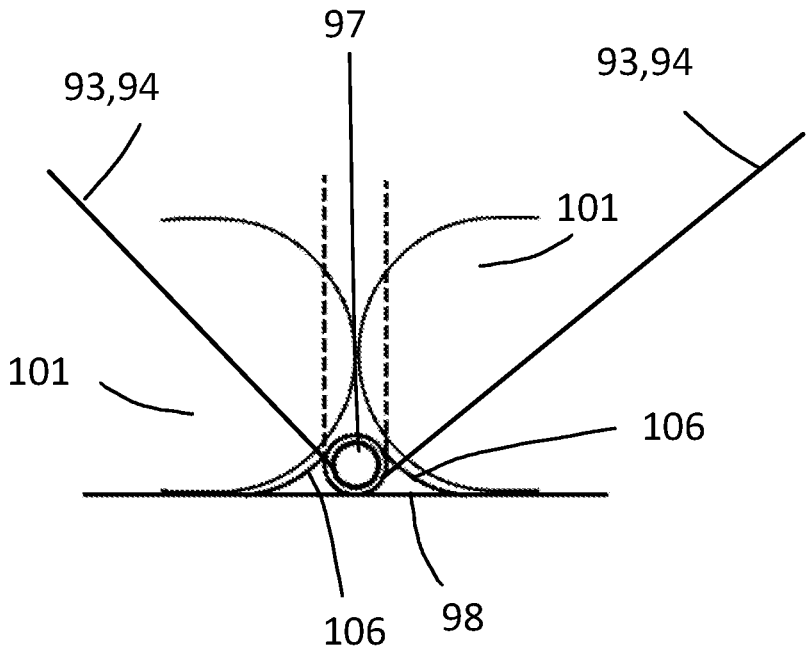

FIG. 4 schematically shows a section from the support of FIG. 3*a* at the location of a force introduction point 97 located between two moldings 99. The course of the flexible support members 106, of the contour of the pneumatic fiber pressure panels 101, and the course of the connecting elements 93, 94 is visible.

A support according to the invention having pneumatic fiber pressure panels, for example a support according to FIG. 3, can only be embodied in such a way that the complete expansion of the fiber pressure panels is not possible by means of the connecting elements 93, 94 (or the connecting elements according to FIGS. 1*a* to 2) under operating pressure of the body, which can be pneumatically pressurized—they then remain at the maximum thickness, which is made possible by means of the fibers. In other words, an expansion reserve then exists, which activates automatically in response to the failure of a fiber pressure panel in the stack (viewed over the height of the pneumatic support): The failed fiber pressure panel then loses its thickness or height, respectively, whereupon the remaining fiber pressure panels continue to expand automatically and thus automatically compensate the thickness or height loss, respectively. In the case of this design, the pneumatic support maintains its full functionality, although its body, which can be pneumatically pressurized, has been damaged and has become partially inoperable.

A pneumatic support, in the case of which the at least one connecting element is embodied in such a way that pneumatic transverse fiber pressure panels remain below their maximum, transverse fiber-related thickness, thus preferably follows.

The at least one connecting element and the layers of pneumatic transverse fiber pressure panels, which reach over the height of the pneumatic body, are then further preferably embodied in such a way that the expansion of the height of the pneumatic body stays substantially constant under operating pressure of the transverse fiber panels, but at pressure loss in one of the transverse fiber pressure panels with expansion of other transverse fiber pressure panels associated therewith.

Pneumatic transverse fiber pressure panels comprising moldings further preferably rest on flexible support members, which are preferably embodied as tapes, and wherein these tapes engage with transverse supports, which are provided at the location of the force introduction points and which, in turn, are operationally connected to the at least one connecting element.

Figure 5:
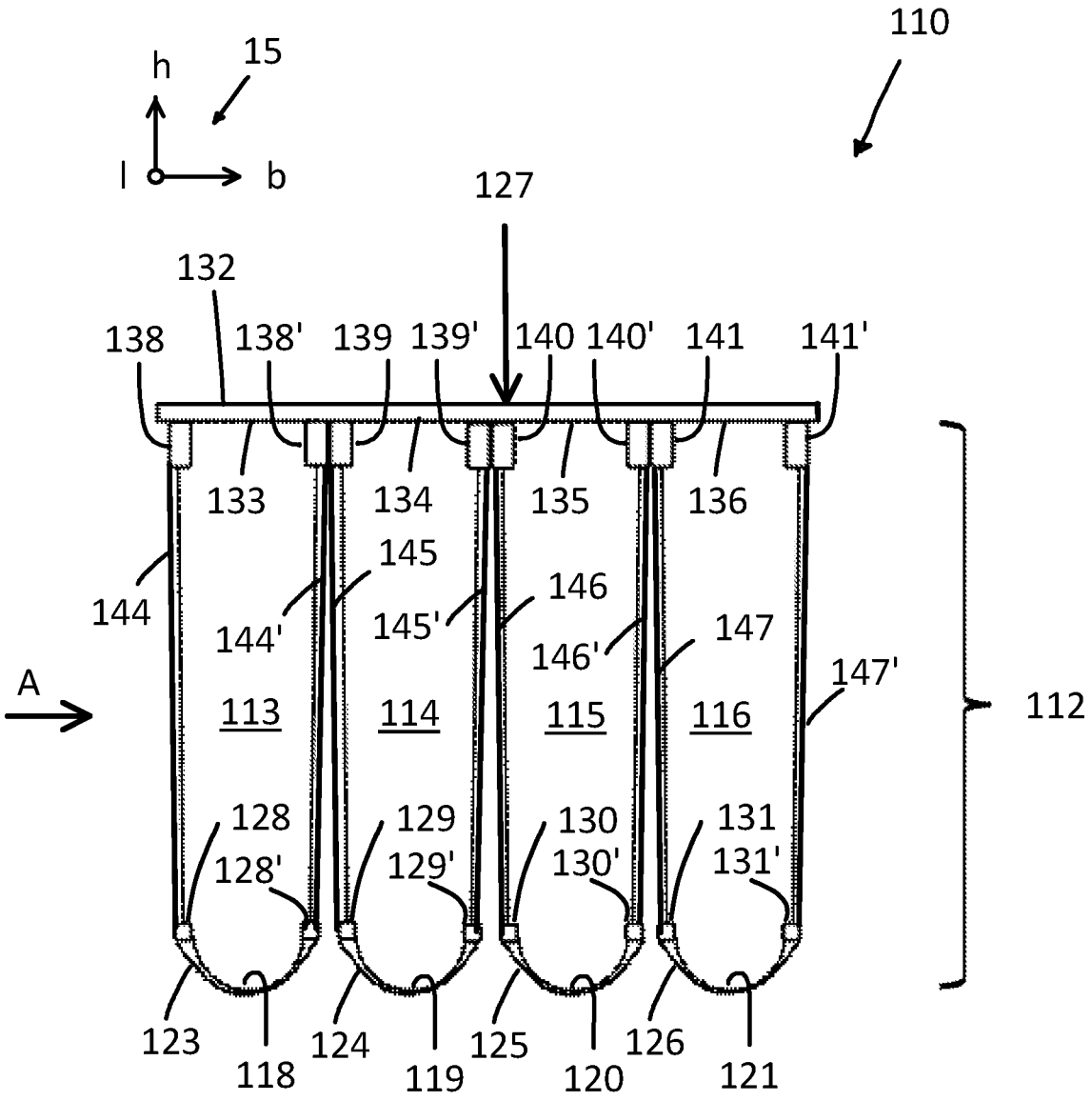

FIG. 5 shows a cross section through a pneumatic support 110 according to the invention according to a further embodiment. Here, the support 110 has a width b, a height H, and a length 1, see the coordinate system 111, thus runs horizontally and is illustrated, in turn, using the example of a bridge. The pneumatic body 112 of the support 110 has transverse fiber pressure panels 113 to 116, which are arranged next to one another and which extend over height h of the body, and which are arranged lengthwise on the support. The transverse fiber pressure panels are thus arranged vertically.

The one (here: lower) longitudinal side of the transverse fiber pressure panels 113 to 116 is preferably rounded. This rounding 118 to 121 can be embodied by means of the mold of the sleeve of the transverse fiber panels 113 to 116 in combination with correspondingly long transverse fibers, or simply in that the correspondingly cut longitudinal side of the sleeve is curved outwards by means of the internal pressure.

A membrane 123 to 126 receives the roundings 118 to 121 via a depression, which is formed diametrically opposed to the roundings 118 to 121, and thus supports the transverse fiber panels 113 to 116, which can thus be loaded by a load 127 acting from the top. For this purpose, the membranes 123 to 126, in turn, are fastened to tensile members 128, 128' to 131, 131' of the support 110, are each stretched by them to form a depression, so that, as a result, the tensile members 128, 128' to 131, 131' support the transverse fiber panels 113 to 116. The tensile members are anchored either at nodes of the support 110, which are not visible in the figure (see, e.g., the nodes or ramps 18, 19, respectively, of FIG. 2 or the nodes 91 of FIG. 3*a*) or, in the case of a segment, such as, e.g., a segment 71 to 73, are connected to connecting points 83, 85 (see FIG. 3).

In the concrete case, the person of skill in the art can also, or only, provide the upper longitudinal side of the transverse fiber panel 113 to 116 with the rounding 118 to 121, and can then operationally connect it via a membrane 123 to 126 to the compression members 138, 138' to 141, 141'.

It follows that at least one (in the illustrated embodiment all) transverse fiber panels have a rounded longitudinal side during operation, which, in turn, are preferably each supported in a preferably flexible membrane, which forms a diametrically opposed depression, wherein the depressions, in turn, are stretched by means of tensile or compression members.

The other (here: upper) longitudinal sides 133 to 136 of the transverse fiber pressure panels 113 to 116 are preferably flattened, wherein a support panel 132 absorbing the load 127 (which can be embodied as roadway slab in the case of a bridge) rests on the flattened longitudinal sides 133 to 136. Compression members 138, 138' to 141, 141' running laterally on the upper longitudinal sides 133 to 136 are connected, preferably screwed, to the support panel 132. The flattened longitudinal side 133 to 136 is preferably created by means of the correspondingly cut sleeve of the transverse fiber pressure panels 113 to 116, and is particularly suitable to take over a load transferred by the support panel 132, and to transfer it via the membranes 123 to 126 to the tensile members 128, 128' to 131, 131'.

In the concrete case, the person of skill in the art can also, or only, flatten the lower longitudinal side of the transverse fiber panel 113 to 116, and can then operationally connect it, for example via a support panel 132, to the tensile members 128, 128' to 131, 131'.

Connecting elements 144, 144' to 147, 147' are preferably arranged at the sides of the transverse fiber panel 113 to 116, wherein the corresponding connecting points are omitted to simplify the figure. These connecting elements correspond to the connecting elements 32, 33 of FIG. 2 or 93, 94 of FIG. 3, respectively.

It follows that preferably at least one (here: all) transverse fiber panel have a flattened longitudinal side during operation, on which a panel-shaped support element for compression or tensile members rests, wherein a compression or tensile member connected to the support panel runs at least on one side of the at least one transverse fiber panel.

In the case of a non-illustrated embodiment, a preferably panel-shaped compression or tensile member can alternatively rest directly on the flattened longitudinal side 133 to 136.

In the alternative, depending on the concrete case, for example some of the transverse fiber panels can further be arranged only over a portion of the height of the support 110, or for example the transverse fiber pressure panels 114 and 115 can be replaced by a single pneumatic body, which has an inflatable sleeve.

According to FIG. 5, a pneumatic support thus follows, in the case of which transverse fiber pressure panels extend between the compression member and the tensile member over at least one height section of the support, preferably over the entire height thereof. The transverse fiber pressure panels are thereby further preferably each arranged over the entire length of the support. Transverse fiber pressure panels preferably extending over the height of the support are finally each arranged over the entire width of the support, as is shown by FIG. 5.

The transverse fiber pressure panels 113 to 116 can have a rectangular, trapezoidal, or a different, in the concrete case, suitable configuration. They can have the entire length of the support, or the length of a segment (for example the segments 71 to 73 of FIG. 2) or can be shorter.

Figure 6:
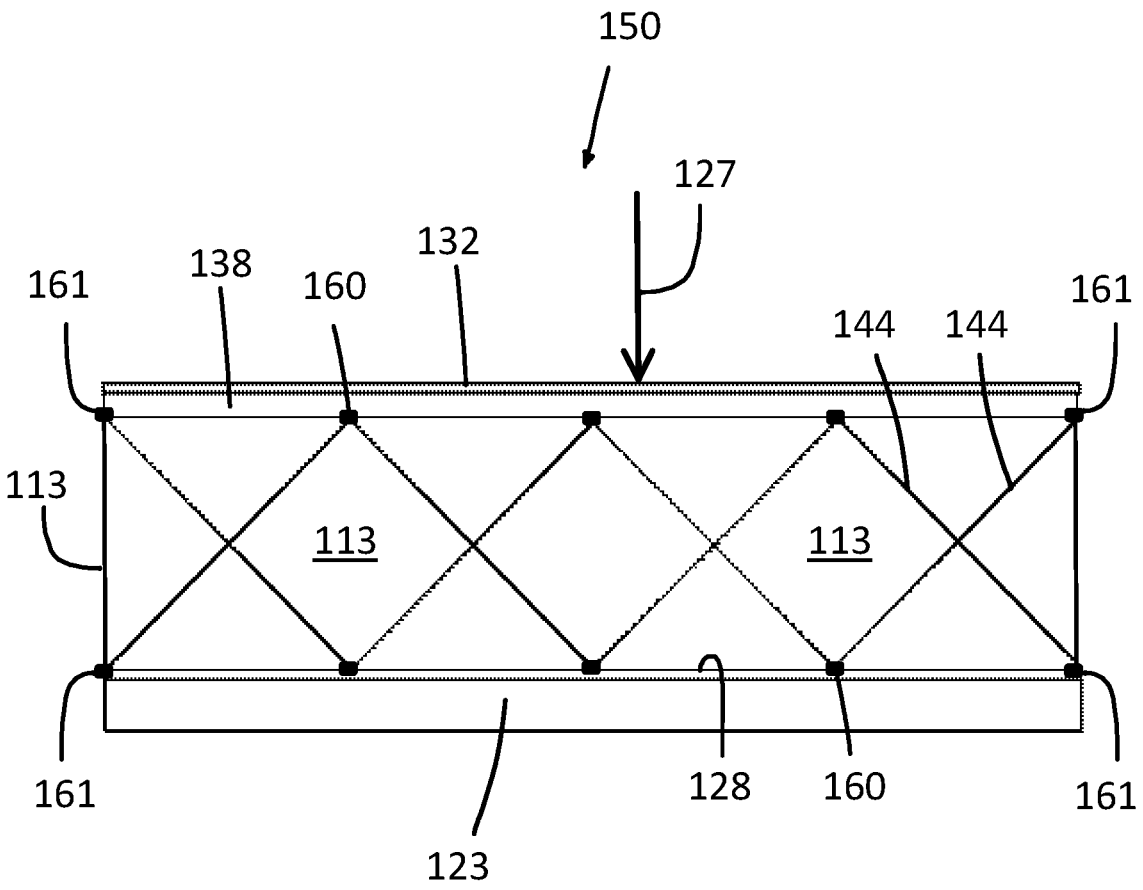
FIG. 6 shows a view from the side onto the support of FIG. 5.

FIG. 6 shows a segment 150 of a pneumatic support of the type of the segment shown in FIG. 5 in the lateral view according to FIG. 5. Here, the segment 150 corresponds to the segment 72 of the support 70 of FIG. 2. The vertically arranged transverse fiber pressure panel 113, which covers the other transverse fiber pressure panels 114 to 116 is visible accordingly. The connecting elements 144 are likewise visible, the other connecting elements 144' to 147' are covered by the transverse fiber pressure panel 113. The compression member 138 as well as the tensile member 128 are likewise visible (the compression members 138' to 141' and the tensile members 128' to 131', in turn, are covered). The membrane 123 is visible, the membranes 124 to 126 are covered. The connecting points 160 correspond to the connecting points 84 of FIG. 2 or the connecting points 95 of FIG. 3*a*, respectively. The connecting points 161 correspond to the connecting points 85 of FIG. 2, because the segment 150 is joined with other segments.

FIG. 6 shows a segment 150 of the pneumatic support according to one of FIGS. 1 to 5 in an exemplary manner. It goes without saying that a non-segmented support according to FIGS. 5 and 6 can also be embodied. In particular a segment or support can further also be provided with moldings according to FIG. 2, see the moldings 86 to 89 of FIG. 2. For this purpose, the transverse fiber pressure panels 113 to 116 can be embodied accordingly with roundings 118 to 121 running in an arc-shaped manner, for example by means of a corresponding mold of the sleeve of the transverse fiber pressure panels 113 to 116, as well as the membranes 123 to 126 (also for example by means of a corresponding mold). At least one transverse fiber pressure panel then results, which extends at least partially over the height of the support, and which forms a bulge between two connecting points.

The embodiment illustrated in FIGS. 5 and 6 has the advantage that only comparatively few transverse fiber pressure panels are required and that the preloading of the connecting elements is easy. It should further be noted in general that virtually only three elements are present for transport and assembly: the support panel (or roadway slab), the transverse fiber pressure panels, and the tensile and compression members, together with the connecting elements, wherein tensile and compression members as well as connecting elements can be preassembled.

The support panel can be made of glued laminated timber, but also as steel grate, or as sandwich composite material. Steel profiles (rectangular or also open C or H profiles) or extruded aluminum profiles can be used for the tensile and compression members. Fiberglass profiles or those of composite materials are likewise possible. Steel cables, Kevlar tapes or other plastic tensile members can be used as connecting elements. The connecting elements can thus also be embodied as Dyneema tapes, i.e. consisting of ultra-high molecular weight polyethylene (UHMWPE), produced by DSM in Holland, or of the plastic by Honeywell known as Spectra. The membranes, which receive the roundings of the transverse fiber pressure panels, can be polyester, PVC or other flexible membranes.

The invention claimed is:

1. A pneumatic support comprising a body, which can be pneumatically pressurized and which, when under operating pressure, operationally holds a compression member, which extends substantially over the length of the body, and a tensile member, which likewise extends substantially over the length of the body, at a distance from one another, wherein, the compression member and of the tensile member are connected to one another on the end side in connecting nodes, characterized in that the body, which can be pneumatically pressurized, has pneumatic transverse fiber pressure panels.

2. A segment of a pneumatic support according to claim 1.

3. The pneumatic support according to claim 1, wherein the connecting element extends between the compression member and the tensile member in a zigzag-shaped manner over a plurality of connecting points each in the region of the compression member as well as in the region of the tensile member, and wherein at least one connecting element is preferably provided at each of the outer sides of the pneumatic support.

4. The pneumatic support according to claim 1, wherein connecting points for at least one tensile connecting element, which extends between the compression member and the tensile member, are provided at the compression member and at the tensile member.

5. The pneumatic support according to claim 4, wherein the compression member and the tensile member have connecting points arranged over their length, into which forces are introduced through the at least one connecting element, and wherein the pneumatic body has moldings, which extend between adjacent connecting points and which protrude outwards via a straight connection between the adjacent connecting points, wherein the moldings are preferably provided on the side of the tensile member.

6. The pneumatic support according to claim 5, wherein compression member or tensile member provided on the side of the moldings abuts on the moldings, but runs over the connecting points between adjacent moldings.

7. The pneumatic support according to claim 1, wherein at least one connecting element is provided, which extends in a zigzag-shaped manner continuously over the entire length of the pneumatic body.

8. The pneumatic support according to claim 7, wherein moldings are formed by pneumatic transverse fiber pressure panels.

9. The pneumatic support according to claim 8, wherein transverse fiber pressure panels are embodied in such a way that the moldings are embodied via their transverse fibers.

10. The pneumatic support according to claim 8, wherein pneumatic transverse fiber pressure panels rest with moldings on flexible support members, which are preferably embodied as tapes, and wherein these tapes engage with transverse supports, which are provided at the location of the connecting points and which, in turn, are operationally connected to the at least one connecting element.

11. The pneumatic support according to claim 1, wherein the body, which can be pneumatically pressurized, has pneumatic transverse fiber pressure panels, which are layered one on top of the other, wherein the layers each preferably consist of a plurality of fiber pressure panels, which are arranged one behind the other and so as to abut against one another, and which are arranged so as to be offset in relation to an adjoining layer.

12. The pneumatic support according to claim 11, wherein the at least one connecting element is embodied in such a way that pneumatic transverse fiber pressure panels remain under their maximum, transverse fiber-related thickness.

13. The pneumatic support according to claim 12, wherein the at least one connecting element and a stack of pneumatic transverse fiber pressure panels reaching over the height of the pneumatic body are embodied in such a way that under operating pressure of the transverse fiber pressure panels, but with pressure loss in one of the transverse fiber pressure panels with associated expansion of other transverse fiber pressure panels, the expansion keeps the height of the pneumatic body substantially constant.

14. The pneumatic support according to claim 1, wherein transverse fiber pressure panels extend between the compression member and the tensile member, over at least one height section of the support, preferably over the entire height thereof.

15. The pneumatic support according to claim 14, wherein transverse fiber pressure panels extending over the height of the support are in each case arranged over the entire length of the support.

16. The pneumatic support according to claim 14, wherein transverse fiber pressure panels extending over the height of the support are in each case arranged over the entire width of the support.

17. The pneumatic support according to claim 14, wherein at least one transverse fiber pressure panel is provided, which extends at least partially over the height of the support, which forms a bulge between two connecting points.

18. The pneumatic support according to claim 14, wherein at least one transverse fiber panel has a rounded longitudinal side during operation, which, in turn, is preferably supported in a membrane, which forms a diametrically opposed depression, which, in turn, is stretched by means of tensile or compression members.

19. The pneumatic support according to claim 14, wherein at least one transverse fiber panel has a flattened longitudinal side during operation, on which a panel-shaped compression member or tensile member rests.

20. The pneumatic support according to claim 14, wherein at least one transverse fiber panel has a flattened longitudinal side during operation, on which a panel-shaped support element for compression members or tensile members rests, wherein at least on one side of the at least one transverse fiber panel, a compression member or tensile member runs, which is connected to the support panel.

* * * * *